United States Patent [19]

Biller et al.

[11] 4,193,053

[45] Mar. 11, 1980

[54] CIRCUIT INTERRUPTING DEVICE WITH ARCING ROD SPEED MODIFYING MEANS

[75] Inventors: Bruce A. Biller, Chicago; Hiram S. Jackson, Glenview; Henry W. Scherer, Mt. Prospect, all of Ill.

[73] Assignee: S & C Electric Company, Chicago, Ill.

[21] Appl. No.: 873,626

[22] Filed: Jan. 30, 1978

[51] Int. Cl.[2] ..... H01H 85/38

[52] U.S. Cl. ..... 337/275; 337/273

[58] Field of Search ..... 337/168, 171, 174, 175, 337/219, 275, 282, 285, 273

[56] References Cited

U.S. PATENT DOCUMENTS

| | | | |
|---|---|---|---|
| 2,087,744 | 7/1937 | Triplett | 337/176 |
| 2,247,704 | 7/1941 | Triplett | 337/251 |
| 2,662,138 | 12/1953 | Lindell et al. | 337/282 |
| 3,118,992 | 1/1964 | Chabala | 337/219 |
| 3,184,568 | 5/1965 | Fahnoe | 337/275 |
| 3,267,235 | 8/1966 | Barta | 337/178 |
| 3,610,855 | 10/1971 | Mitsuhashi et al. | 200/150 |
| 3,629,767 | 12/1971 | Schmunk | 337/235 |
| 3,629,768 | 12/1971 | Scherer | 337/275 |
| 3,855,563 | 12/1974 | Cameron et al. | 337/221 |

*Primary Examiner*—Harold Broome

*Attorney, Agent, or Firm*—John D. Kaufmann

[57] ABSTRACT

A lead weight or other mass is crimped to the contact button assembly of the arcing rod of a high-voltage alternating-current power fuse thereby increasing the mass of the arcing rod without increasing the diameter of the rod. The increased mass of the arcing rod decreases the velocity with which the arcing rod moves upon fusing of the fusible member thereby decreasing the rate of elongation of the arc drawn between the end of the arcing rod and the stationary ferrule at the other end of the fuse. Under high current conditions, the shorter arc length drawn in the fuse reduces the pressure of the arc-extinguishing gas generated by the arc, thereby reducing the risk that an economically constructed fuse will burst in those situations when the arc is not interrupted at the first current zero. This result is accomplished without adversely affecting operation of the fuse and interruption of the arc at low current levels.

11 Claims, 2 Drawing Figures

CIRCUIT INTERRUPTING DEVICE WITH ARCING ROD SPEED MODIFYING MEANS

BACKGROUND OF THE INVENTION

1. Field of the Invention

This invention relates generally to high-voltage alternating-current power fuses, and more particularly to techniques for modifying such fuses in a minor fashion to render them more effective circuit interrupters. This invention also relates to a deviation from the related invention disclosed and claimed in commonly-assigned U.S. Pat. No. 3,629,767 (hereinafter the "'767 Patent"). The '767 Patent relates to a damper body which reduces the speed of a moving rodlike terminal or arcing rod, in a fuse of the type usable at voltages of 34.5 kV and above and itself is related to fuses of the type disclosed and claimed in commonly-assigned U.S. Pat. No. 3,267,235. The present invention particularly relates to improvements in fuses usable at voltages of 34.5 kV and below as contrasted to the higher voltage fuses of the above-cited patents.

2. Description of the Prior Art

In high-voltage power fuses for alternating-current system protection, the current to be interrrupted produces an arc on severance of a fusible element. One end of the arc terminates on a stationary terminal at an exhaust end of the fuse. The other end of the arc terminates on a tip of a rodlike terminal or arcing rod, which is subsequently withdrawn into a constricted bore formed in material or materials that evolve large quantities of arc-extinguishing gas under the intense arc heat. The amount of gas evolved is a function of bore materials, bore diameter, current magnitude and length of bore material exposed to the arc. As the gas is evolved, it is important that it be effectively vented, preferably at only the exhaust end of the fuse, so that the gas not only moves at high velocity as it exhausts but sweeps along the arc path in a single direction which causes constricting and cooling of the arc.

As the arc is lengthened by withdrawing the rodlike terminal, current zeros or arc zeros occur at periodic times. These times, measured from the start of arcing, depend upon circuit frequency, fault initiating angle (relative to driving voltage zero), circuit power factor and current asymmetry decrement. At each current zero, there is an attempt made by the fuse to clear-this clearing being accomplished if the just-previous arc path can withstand the recovery voltage impressed across it. The ability to withstand this recovery voltage depends upon (a) the amount of gas generated by the arc, (b) the arc length just prior to the current zero, (c) the added terminal separation in the submillisecond an millisecond range after current zero is reached, (d) the temperature of the arc terminals, (e) the amount of metallic vapor in the bore and the exhaust gases, and (f) the effectiveness of gas flow out of the exhaust. Item (a), in turn, depends upon the fault current level, bore diameter and also arc length, as well as the factors noted in the previous paragraph.

For a fuse of given voltage rating, the magnitude and natural frequency of the recovery voltage are primarily dependent on circuit parameters and not on the fuse. Fault current levels in the full range from a minimum melt up to the interrupting rating of the fuse must be coped with. To handle the lower current ranges promptly requires that certain bore sizes, within narrow limits, be assigned to specific ranges of fusible element sizes. The necessary use of metallic stationary terminals and rodlike terminals does not allow for much control over the amount of metallic vapor produced, these being controlled mostly by fault level and arcing time. Venting effectiveness is within the designer's control only to the point of achieving smooth flow up to the acoustic velocity at the exhaust. Longer than necessary arc lenghts make this control more difficult to maintain.

As can be seen, a parameter of important significance that the fuse designer should seek to control is that of arc length. It has been found by extensive testing that, for a given fuse voltage size, a certain minimum gap or arc length (terminal separation) is required to clear. This minimum gap must be accompanied by sufficiently large gas generation. As gas volume is reduced (at lower currents), longer minimum gaps are required. Difficulties arise when, at an early current zero, there is either insufficient gas generation or insufficient gap, and the fuse must await the next current zero. During this waiting period, the combination of current and long arc length produced by an ever more rapidly moving rodlike terminal, can generate so much gas so deeply within the fuse that even efficient venting at the exhaust end cannot prevent the buildup of excessive pressure within the fuse housing. Violent rupture of the fuse housings may result, and it is not economically feasible to merely strengthen the fuse housing. These conditions (i.e., of a just-missed current zero followed by an intolerably long arc gap before next current zero) occur with many combinations of current level, current asymmetry and element size.

One may adjust the parameters of a fuse so that a specific combination of current-asymmetry and element size results in a safe clearing condition, only to find that a new combination (that gave safe clearing with previous design parameters) yields unsafe clearing conditions. In the higher voltage fuses of the '767 Patent it was found that the addition of mass to the arcing rod only after its initial acceleration retarded travel thereof at later stages of such travel to permit both efficient high and low fault current interruption. In the lower voltage fuses of this invention it has been found desirable to add mass to the arcing rod at all times. Such addition of mass is achieved without affecting the length or diameter of the rodlike terminal used in a fuse of a given voltage and current rating.

This apparent disparity between the '767 Patent and the present invention is believed to be explained by the following analysis. In the higher voltage fuses of the '767 Patent, the fuse housing is quite long. This leads to the arcing rod also being quite long. The shorter, lower voltage fuses of the present invention have correspondingly shorter arcing rods. The arcing rods of both types of fuses can have diameters of three sizes depending upon the continuous current rating of the fuses. Typically, these arcing rod diameters are 3/16" for current ratings in the range 1 to 40 amperes, ¼" for current ratings ranging from 5 to 125 amperes, and 5/16" for current ratings from 150 to 200 amperes. Thus, for a given arcing rod diameter, the arcing rods of the higher voltage fuses have more mass than their lower voltage counterparts.

The arcing rods are attached to fusible elements which will fuse and allow withdrawal of the arcing rod as a result of two forces acting upon the arcing rod. The first driving force source is usually a stored energy device, typically a spring. There are several purposes served by this spring. First, in all cases (high and low currents) the spring must furnish sufficient force to overcome the friction between the arcing rod and the sliding contact arrangement which electrically connects the arcing rod to a conductive end ferrule on the fuse remote from the exhaust end; second, at low currents, the spring must provide all the energy for withdrawing the arcing rod; third, at high currents, the spring need only initiate arcing rod acceleration, the pressure of evolved gas soon thereafter "swamping" the spring force. Since the fuses of all current ratings share in a common design of contact arrangement, it is typical and convenient from the standpoint of manufacturing to use springs which apply a given driving force to the arcing rods for all current ratings of the fuse. The springs used in the fuses of the '767 Patent are compression springs which in their fully compressed state exert about 26 pounds of force on the arcing rod. The compression springs of the fuses of the subject invention exert about 11 pounds of force. Thus, comparing the accelerative effect of the 26 pound spring on the minimum ½ pound arcing rod of the '767 Patent to the accelerative effect of the 11 pound spring on the 0.142 pound (minimum) and the 0.4 pound (maximum) arcing rods of the present invention, shows that the initial acceleration by the springs of the '767 Patent arcing rods is about 2.9 to 8.4 times greater than the initial acceleration of the present arcing rods before mass is added thereto. The initial acceleration of the '767 Patent arcing rods is also about 2.4 to 6.5 times greater than the initial acceleration of the present arcing rods after mass is added thereto.

At higher currents, a second source of driving force on the arcing rods is the pressure generated by the arc-extinguishing gas evolved which drives the arcing rod as a piston, and which swamps the driving force of the spring soon after arc initiation. The gas driving force depends on the gas pressure built up in the fuse, which in turn depends on the amount of energy causing gas evolution and the effectiveness of the fuse exhaust in venting such gas from the fuse. The energy in turn, depends on the level of fault current being interrupted and the angle, referenced to the circuit voltage, at which he fault is initiated. It is well known that the closer fault initiation is to 90 degrees of the circuit voltage (i.e., a voltage positive or negative maximum) the more symmetrical is the waveform of the current through the fuse. The closer the fault initiation is to 0 degrees of the circuit voltage (i.e., a voltage zero) the more asymmetrical the current waveform is. Moreover, as current asymmetry increases, the arc energy is greatly increased during alternate major loops of current over the amount it would have been under symmetrical conditions. Intervening minor loops have decreased energy as compared to symmetrical conditions. This is a crucial state of affairs in a fuse.

Assuming both high fault current and high asymmetry, huge amounts of arc energy result, causing the evolution of large amounts of gas and consequent high gas pressure during major loops. These conditions obtain early in the movement of the arcing rod during which time an insufficient gas may exist between the arcing rod and the stationary terminal to effect arc extinguishment notwithstanding the gas pressure. A current zero may be, therefore, just "missed". Due to asymmetry, the next following current loop has a low magnitude, and, therefore, although a larger gap exists between the arcing rod and the stationary terminal, the low energy incident to such low arc current is likely to generate insufficient gas to extinguish the arc. The next following current loop is accompanied by even larger amounts of arc energy and gas generation due to the now long length of arc interacting with the arc-extinguishing material, so large in fact, that a fuse housing made of economically feasible material bursts.

Worst case conditions (high fault current, high asymmetry) are not too critical to the higher voltage fuses of the '767 Patent. Specifically, the higher mass of their arcing rods is sufficient to adequately resist these high gas pressures at the beginning of arcing rod stroke so that without added mass thereon, the arcing rod stays sufficiently close to the stationary terminal. If the first current zero is "missed", the next current zero occurs without an overly extended arc interacting with a great length of the arc-extinguishing material. Thus, the current may be interrupted at the next current zero. If it is not, the massive arcing rod, plus the now, picked up mass ensure sufficient gas (without the arc reaching the top of the fuse) to extinguish the arc.

The worst case in the fuses of the present invention presents serious problems. The less massive arcing rods are literally jetted through the bore. The normally lighter arcing rods do not have the "luxury" of moving slowly away from the stationary terminal. They move away too quickly. The high arc energies (alternating with low arc energies as more asymmetry is present) often result in excessively elongating the arc prior to arc interruption taking place; as a result, the economically viable fuse housing bursts.

In sum, relatively low arc energy clearings (due to only limited arc elongation) under worst case conditions are much more likely to occur in the '767 Patent fuses than in the present fuses. Thus, the more massive '767 Patent arcing rod acceleration need not be modified early in the stroke, while the lighter arcing rods of the subject invention should be modified to prevent bursting of an economically constructed fuse housing under worst case conditions.

In best case situations (low fault current, high symmetry), especially with low arc energies (due to only limited arc elongation), the situation is somewhat reversed. The lighter arcing rods of the present invention, once moving due to the spring, are more easily influenced by gas pressure and can easily achieve sufficient separation from the stationary terminal to extinguish the arc notwithstanding the lower gas pressures present. The arcing rods of the '767 Patent, however, having more mass, are initially moved more slowly by the gas pressure. Thus early current zeros may find both insufficient gas and gap for interruption to occur. Should this occur, further arcing rod travel coupled with the relatively low energy available may lead to later large gaps, but yet insufficient gas.

Thus, it should be clear that adding a mass to the '767 Patent arcing rods after some movement thereof solved problems in both best and worst case situations. The less crucial worst case for the '767 Patent fuses is helped somewhat by the mass, but chances are the fuse will clear at the first current zero without an excessively long arc due to the more massive arcing rods. The more crucial best case requires the added mass to ensure the fuse may take advantage of current zeros after the first current zero without carrying the arc to the top of the fuse.

Picking up a mass by the less massive arcing rods is of little aid: Either the $\frac{1}{2}MV^2$ of the arcing rod may be too great if the pick-up mass is too light, or, if a heavier mass is used, pick-up would occur after only a very slight amount of arcing rod movement. Moreover, as a practical matter, the mechanism of the '767 Patent requires more room than is available in the lower voltage fuses of this invention. The '767 Patent fuses are larger in length and diameter; the present fuses are too small to conveniently take advantage of the teachings of the '767 Patent.

It should be pointed out that the high energy situations in the lower voltage fuses might well be helped by either severe counterboring of the bore near the fusible element or by a larger diameter (and hence more massive) arcing rod. However, both of these solutions are deleterious to low current (i.e., low energy or best case) interruption. For low current interruption in fuses of a give voltage rating, better action is achieved with smaller diameter arcing rods and bores.

Thus, for the lower voltage fuses of the present invention, it has been found best to add mass permanently to the low mass arcing rods. This slows down the arcing rod movement, as compared to unmodified arcing rods, so that (a) the smallest diameter arcing rods which may clear in one current loop cannot draw excessively long arcs, and (b) the larger diameter relatively low mass arcing rods which can rarely be accelerated sufficiently by the smaller spring to clear in one loop also cannot draw excessively long arcs in case an early current zero is "just missed".

Stated differently, it has been found that, in the lower voltage fuses, the combined action of the spring and the gas pressure, especially at high currents, are far more likely to move the arcing rod past the minimum clearing gap prior to the first current zero, than is the case in the higher voltage fuses, which experience primary difficulty to lower currents.

SUMMARY OF THE INVENTION

The present invention, therefore, contemplates adding a weight or mass to the arcing rod in such a manner as to not interfere with its movement though the bore but so that, especially at high gas pressures, arcing rod movement is such as to permit arc extingusihment at an early current zero. Preferably, the weight is crimped onto the top of the arcing rod on or near the contact button assembly. It has been found that a mass equal to from about 15–30% of the initial mass of the arcing rod works well, with a preferred percentage range being 18–26%. The weight is preferably a lead body crimped onto a circumferential groove in the contact button assembly. The addition of the weight has been found to vastly improve the high current interruption capability of lower voltage fuses without adversely affecting their low current interruption capability.

DETAILED DESCRIPTION OF THE PREFERRED EMBODIMENT

Figure 1:
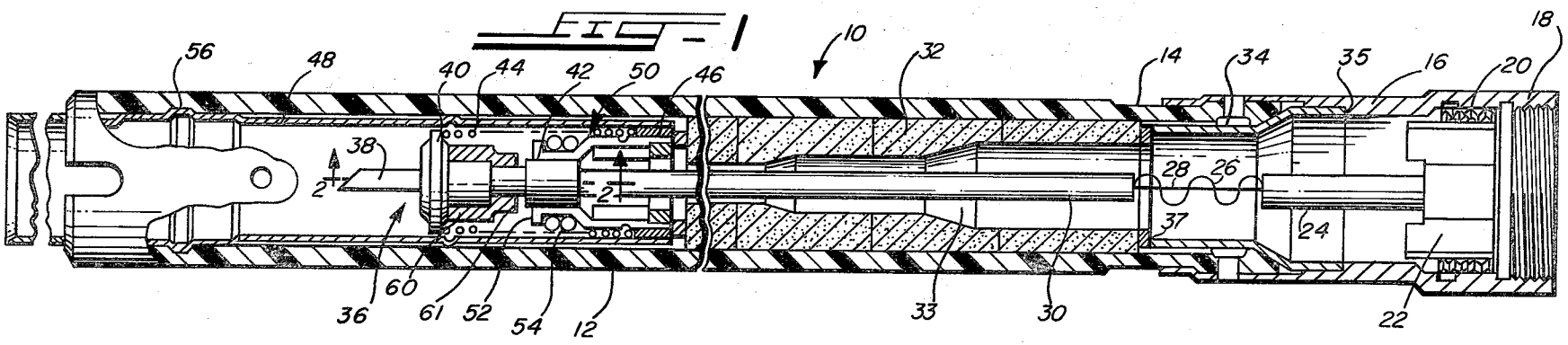
FIG. 1 is a side, cross-sectional, partially fragmentary view of high-voltage fuse having the present invention incorporated therein.

With reference to FIG. 1, illustrated is a typical expulsion type high-voltage fuse 10. Fuse 10 comprises a hollow insulator tube 12 that can be fabricated from any conventional organic insulator materials such as fiberglass, phenolic, or epoxy resin. Insulator tube 12 has an exterior annular groove 14 adjacent one end thereof, and a metallic end fitting in the form of an exhaust ferrule 16 is attached to the end of the insulator tube 12 by compressing the end of the ferrule 16 into the groove 14. Two sets of threads 18 and 20 are provided within the end of ferrule 16. Threads 20 accomodate a contact bridge 22 which is threaded into the end of ferrule 16, and threads 18 may be utilized to attach a rain cap or exhaust device as appropriate or necessary.

Attached to contact bridge 22 and extending therefrom in a cantilever fashion is a column-shaped element 24 which has attached to the end thereof a fusible element 26 which may be fabricated from silver alloy and a strain wire 28 which may be fabricated from nickel-chrome alloy. Fusible element 26 and strain wire 28 are connected at their opposite ends to an arcing rod 30 which extends through a hollow bore 33 through the center of a stack of cakes of arc-extinguishing material 32. Arc-extinguishing material 32 may be made of boric acid or any other suitable material that emits an arc-quenching gas when exposed to an electric arc. An exhaust tube 34 is mounted within insulator tube 12 and retained between a flange 35 on the interior of ferrule 16 and a gasket 37 positioned against the cakes of arc-extinguishing material 32.

Mounted on the other end of arcing rod 30 is a contact button assembly 36 wich includes a striker pin 38 extending from a button flange 40 mounted to the end of an electrical contact 42 attached to the end of arcing rod 30. A spring 44 engages the edge of flange 40 and is compressed between button flange 40 and flange 46 mounted in the end of a metallic conducting tube 48. A contact assembly 50 is mounted on the interior of flange 46 at the end of conducting tube 48. Contact assembly 50 comprises a plurality of contact fingers 52 which are biased inwardly by a garter spring 54 to assure electrical contact with contact 42. Conducting tube 48 is attached to the interior of insulator tube 12 by an expansion joint 56 and the end of conducting tube 48 extends from the end of insulator tube 12 to form a metallic fitting at that end of the fuse. In typical service, conducting tube 48 is connected to one side of an electrical circuit and ferrule 16 to the other side of the circuit. When fuse 10 operates, fusible element 26 and strain wire 28 melt allowing arcing rod 30 to be accelerated by spring 44 through the hollow opening 33 in the cakes of arc-extinguishing material 32.

Figure 2:
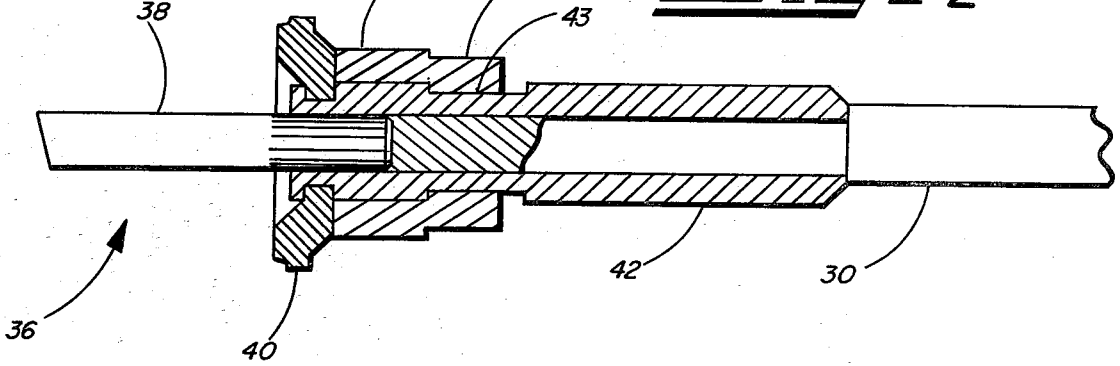
FIG. 2 is a cross-sectional, partially fragmentary view taken substantially along line 2—2 in FIG. 1.

With reference to FIGS. 1 and 2, mass 60 made of lead or other suitably dense material is secured to, added to, or formed as a part of, the arcing rod 30. For example, the mass 60 may be mounted to electrical contact 42 of the contact button assembly 36 and, therefore, to arcing rod 30 by means of crimp 61 in mass 60, which engages groove 43 in electrical contact 42.

We claim:

1. An improved high voltage fuse for interrupting fault currents of both low and high level ranges, the fuse being of the type having: an insulative housing carrying thereon a pair of opposed terminals connectable to opposed points of a circuit; an elongated body of a solid arc-extinguishing material within the housing, the body having a bore therethrough of a first diameter; an elongated arcing rod having a second diameter slightly smaller than the first diameter and being movable by a spring member through said bore upon fusing of a fusible element normally preventing such movement, so that an arc, terminated on one end of the arcing rod and on a stationary terminal away from which the arcing rod moves, is elongated by such movement to interact within said arc-extinguishing material to generate arc-extinguishing gases; the diameters, the mass of the arcing rod and the rate of the spring member being so related as to efficiently extinguish low fault current, but being so related as to inefficiently extinguish the high fault current levels; wherein the improvement comprises:

a member continuously and at all times attached to the arcing rod at a position so as to not interfere with its movement or to affect the relationship between the diameters, the member adding sufficient mass to the arcing rod so that the acceleration thereof through the bore is decreased from the acceleration the arcing rod would have without the member to render efficient the extinguishment of high fault current.

2. The fuse of claim 1, wherein a spring of the same spring rate is used in all fuses of a given voltage rating, and the diameters are increased within a given voltage rating in proportion to the continuous current rating of the fuse.

3. The fuse of claim 2, wherein said member comprises:

a quantity of a material more dense than the material of which the arcing rod is made incorporated onto the arcing rod at a location whereat the member is not exposed to the action of the arc.

4. The fuse of claim 2, wherein the increase in mass of the arcing rod is from 15–30%.

5. The fuse of claim 4, wherein the second diameter is 3/16 inch, the voltage rating of the fuse is 14.4 kV and the mass of the arcing rod is increased by about 22%.

6. The fuse of claim 5, wherein the initial mass of the arcing rod is about 64 grams and the increased mass is about 82 grams.

7. The fuse of claim 4, wherein the second diameter is 3/16 inch, the voltage rating of the fuse is 25 kV and the mass of the arcing rod is increased by about 26%.

8. The fuse of claim 7, wherein the initial mass of the arcing rod is about 74 grams and the increased mass is about 100 grams.

9. The fuse of claim 4, wherein the second diameter is ¼ inch or 5/16 inch, the voltage rating of the fuse is 34.5 kV, and the mass of the arcing rod is increased respectively by about 23% or 18%.

10. The fuse of claim 9, wherein the initial mass of the arcing rod is respectively about 130 grams or 180 grams and the increased mass is respectively about 169 grams or 221 grams.

11. An improved high-voltage fuse for interrupting both low and high fault currents, the fuse being of the type having: an insulative housing carrying thereon circuit-connectable terminals; an elongated body of a solid arc-extinguishing material within the housing, the body having a bore therethrough; an elongated arcing rod movable through the bore under the influence of a spring member and the pressure of gas evolved from the arc-extinguishing material upon the fusing of a fusible element normally preventing such movement so that an arc, terminating on one end of the arcing rod and on a stationary terminal away from which the arcing rod moves, is elongated by such movement to interact with the arc-extinguishing material to evolve gas therefrom; the lengths of the housing and the arcing rod being substantially the smallest possible for use at voltages of about 34.5 kV or lower; the diameters of the arcing rod and the bore being substantially the smallest possible consistent with the continuous current rating of the fuse, to ensure low fault current interruption at substantially the first current zero following fusing of the fusible element; the arcing rod having a mass of between about 64–180 grams; wherein the improvement comprises:

a dense member on the arcing rod at a position so as to not interfere with its movement, substantially increase its length, or affect the relationship of the diameters, the member adding 15% to 30% to the arcing rod mass so that acceleration thereof through the bore is constantly decreased from the acceleration thereof without the member thereon to render efficient the interruption of high-fault currents.

* * * * *